United States Patent [19]

Schmidt et al.

[11] Patent Number: 4,815,791

[45] Date of Patent: Mar. 28, 1989

[54] BEDDED MINERAL EXTRACTION PROCESS

[75] Inventors: Robert D. Schmidt, Isanti; Jon K. Ahlness, Minneapolis, both of Minn.

[73] Assignee: The United States of America as represented by the Secretary of the Interior, Washington, D.C.

[21] Appl. No.: 111,246

[22] Filed: Oct. 22, 1987

[51] Int. Cl.[4] ..... E21B 43/28

[52] U.S. Cl. ..... 299/4; 166/191; 166/313; 299/5

[58] Field of Search ..... 299/4, 5; 166/269, 52, 166/313, 191

[56] References Cited

U.S. PATENT DOCUMENTS

| | | | |
|---|---|---|---|
| 2,818,240 | 12/1957 | Livingston | 299/4 |
| 3,309,141 | 3/1967 | Fitch et al. | 299/4 X |
| 3,667,545 | 6/1972 | Knight | 166/269 |
| 4,105,252 | 8/1978 | Moore | 299/4 |
| 4,184,549 | 1/1980 | Schievelbein | 166/269 |
| 4,387,770 | 6/1983 | Hill | 166/269 X |
| 4,544,206 | 10/1985 | Wier et al. | 299/4 |

*Primary Examiner*—Stephen J. Novosad

*Attorney, Agent, or Firm*—E. Philip Koltos

[57] ABSTRACT

Process for obtaining increased yields of minerals from bedded ore desposits in the absence of natural confining beds, by confining the flow of leach solution to the mineralized zone through operation of wells comprising, (a) injecting ground water into the barren zones above and below the mineralized zone while simultaneously injecting leaching solution into the mineralized zone at a single injection well location, and (b) recovering ground water from barren zones while simultaneously recovering leaching solution from the mineralized zone at a single recovery well location.

9 Claims, 9 Drawing Sheets

BEDDED MINERAL EXTRACTION PROCESS

FIELD OF THE INVENTION

The invention pertains to an improved in situ mining method for extracting bedded mineral deposits from a permeable mineralized zone when the mineralized zone is overlain and/or underlain by barren zones of equal or higher permeability.

The improved method is accomplished by confining leach solution to the mineralized zone, and entails injecting and recovering ground water in barren zones, coincident with injecting and recovering of leach solution in the mineralized zone by means of nested wells. Nested wells permit simultaneous injection (or recovery) of leach solution and ground water from a single well bore.

BACKGROUND OF THE INVENTION

In prior methods of leaching bedded ore deposits, such as uranium rollfront deposits, leachant injection and recovery wells are constructed. Leachant is introduced in the mineralized zone at the injection well. It flows through permeable rock to a recovery well in response to the gradient in hydrostatic pressure created by well recharge and discharge. Permeability [$L/T^2$] is the capability, per unit thickness, of a porous rock material to convey ground water (or leach solution). Transmissivity [L /T] is permeability multiplied by thickness, and is a measure of aquifer capability to transmit ground water.

Injection and recovery well spacings of 50 to 100 feet are typical. Injection and recovery wlls are open to fluid flow only in the mineralized zone. Above and below the mineralized zone, the well is cased and cemented to prevent excursions of the leach solution from the well bore into other aquifers.

Conventional leaching operations rely on the presence of overlying and underlying rock layers having permeabilities much lower than that of the mineralized zone to confine the leach solution, from above and below. Clay or shale beds are examples of natural barriers which confine the flow of leachant within the mineralized zone.

While natural confining beds are almost always present, often they do not lie adjacent to the mineralized zone. When mineralization occurs as a narrow band of precipitate within a thicker sandstone unit, the adjacent barren sandstone generally has a higher pemeability than the mineralized zone. In this case, despite the fact that injection and recovery wells are open only to the mineralized zone the leach solution will flow preferentially through the higher-permeability barren layers, above an below the mineralized zone.

In conditions such as this, contact between the leach solution and the mineralized zone is significantly reduced and the geochemical processes of leaching are substantially inhibited.

Computer simulations of leaching hydrology and geochemistry provide a graphical means of confirming that a substantial amount of leachant does flow outside the mineralized zone in the conventional leachant flow pattern.

For example, the plot of FIG. 2 shows a cross-sectional representation of a conventional leachant flow pattern between a single pair of injection and recovery wells. The flow pattern (represented by 7 symmetric pairs of streamlines) is developed for a layered aquifer setting where the low permeability confining beds ($k_2$) are separated from the mineralized zone ($k_0$) by a higher permeability barren zone ($k_1$). This corresponds to the type A or type C deposit in FIG. 1. 1. This flow pattern was generated using hydrogeologic field data from an operational uranium leach site. Streamlines in this and all subsequent plots are constructed so that an equal volume of leach solution flows between each adjacent pair of streamlines.

Field data used in this simulation is summarized as follows:

TABLE 1

Hydrologic Data, South Texas Uranium Leach Site

| Layer | Permeability (gal/day/ft$^2$) | Thickness (ft) | Transmissivity (gal/day/ft) |
|---|---|---|---|
| zone $k_2$ | .002 | NON/Applicable | 0 |
| zone $k_1$ | 63.5 | 15 | 952.5 |
| zone $k_0$ | 6.05 | 3 | 18.15 |
| zone $k_1$ | 63.5 | 10.5 | 666.75 |
| zone $k_2$ | .002 | NON/Applicable | 0 |

| | |
|---|---|
| depth to zone $k_0$ | 200 ft |
| depth to water (ambient level) | 15 ft |
| well spacing | 37.5 ft |
| leachant injection and recovery rate | 2 gallons/minute |
| average leachant velocity | 18.0 ft/day |

As table 1 indicates, the ratio of permeabilities between barren and mineralized zones is $k_1/k_0=10$.

In FIG. 2, despite the fact that the wells are open only to the ore zone, leachant contact with the ore material is limited to a small area around the open interval of each well. Between the wells, the leach solution flows almost entirely through barren rock. This is a direct result of the greater permeability and thickness (transmissivity) of the barren zones.

When the barren rock layer intervening between the mineralized zone and the confining bed is thin relative to the mineralized zone, or has a roughly equivalent permeability, there is less migration of leach solution into the barren zone.

The streamline pattern in FIG. 3 results when the permeabilities of barren and mineralized zones are the same, i.e. $k_1/k_0=1.0$. In this case, approximately 21 percent of the leach solution remains entirely within the low permeability mineralized zone, 79 percent of the leach solution is wasted because its flow path is mostly in the barren zone.

In homogeneous cases like FIG. 3, it is practical to increase the injection and recovery rates of leach solution in order to increase the concentration of leach solution inside the mineralized zone. Since the injection and recovery rates in these simulations are already at their maximum practical value, given a 3 foot open interval of well casing, it is necessary to lengthen this open interval in order to increase the rates still further.

FIG. 4 is a flow simulation developed for the case where the open interval is centered on the mineralized zone, and is twice its thickness. (Only the streamlines beginning inside the mineralized zone are plotted) In this simulation 29 percent of the leach solution injected inside the mineralized zone remains inside, and this represents an 8 percent increase over that of FIG. 3. The injection and recovery rates are increased by a factor of 2 over that of FIG. 3, however.

The problem of maintaining solution/mineral contact becomes much greater if the permeability of the barren rock layer greatly exceeds that of the mineralized layer.

Permeability ratios of 10:1, 100:1 and 1000:1 have been encountered at leaching operations, and in these cases, increasing the open interval is not practical because it would mean increasing leachant injection and recovery rates by a factor of 20, 200 or 2000 in order to achieve the same 8 percent increase in leachant/mineral contact observed in FIG. 4.

Therefore, it can be clearly seen that increasing the open interval in the casing, and thereby increasing the injection and recovery rates, is not a practical means of inducing greater leachant/mineral contact in situations where natural confining beds are absent.

SUMMARY OF THE INVENTION

The limited contact between the leaching solution and the mineralized zone in the prior art process is overcome by the invention's method of confining leach solution to the mineralized zone through injection and recovery of ground water in the barren zones, coincident with injection and recovery leach solution in the mineralized zone.

Coincident ground-water and leachant injection (or recovery) is accomplished by means of a nested injection (or recovery) wells. Nested wells allow simultaneous injection (or recovery) of leachant and ground water from a single well bore. Nested well designs which permit independent control of the injection and recovery rates in barren and mineralized zones are described.

DETAILED DESCRIPTION OF THE PREFERRED EMBODIMENT

Figure 5:
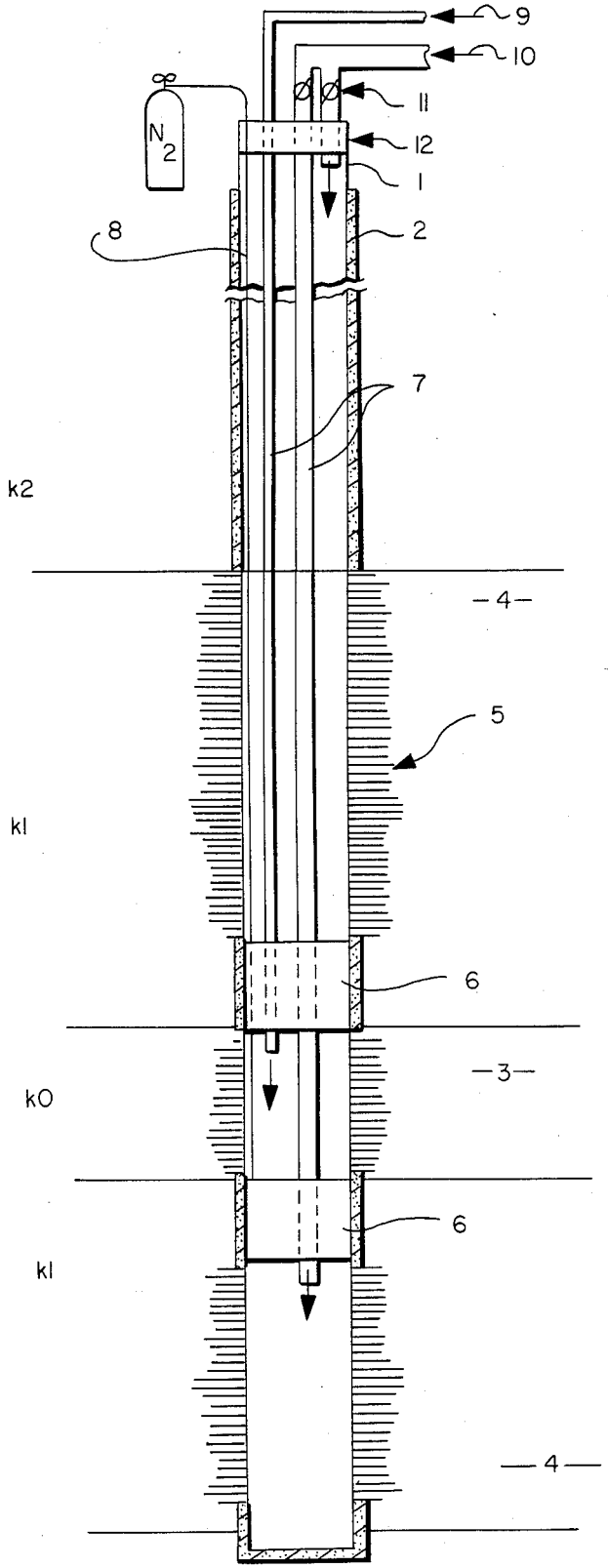
FIG. 5 is a diagram of a nested injection well design.

In the nested injection well illustrated in FIG. 5 a well casing (1) is placed in an open hole and cemented (2) from the surface through both the mineralized (3) zone and the barren zones (4). The casing and cement are then perforated (5) throughout both the mineralized and barren zones; however, for a short interval at the top and bottom of the mineralized zone are not perforated. An assembly consisting of two inflatable packers (6) and two small-diameter solution injection pipes (7) is lowered inside the casing. The length of pipe separating the two packers permits them to be set at the exact levels of the unperforated casing. One of the access pipes is open to the well in the interval between the two packers. The other extends through both packers, and is open to the well in the interval below the lower packer.

When the packers are inflated, with a gas through the packer inflation tubing (8) the well is divided into three hydraulically isolated sections. Leach solution (9) is injected in the mineralized zone between the two packers via the shorter of the two access tubes. Ground water (10) is injected in the barren zones above and below the mineralized zone via the open well bore and the longer access tube. Valves (11) at the sealed well head (12) are used to independently control injection pressures of leachant and ground water.

Figure 6A:
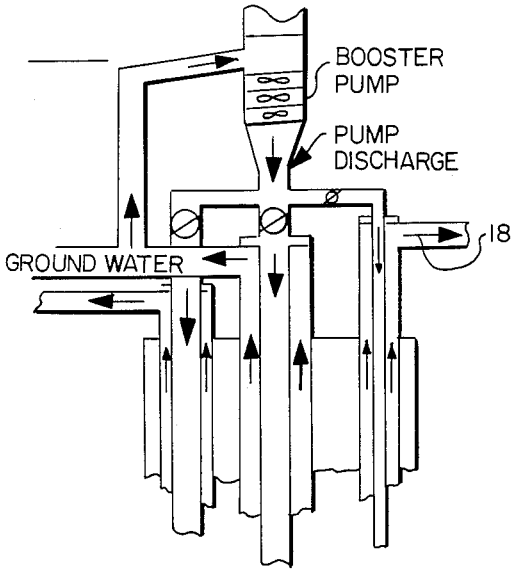
FIGS. 6A and 6B show enlarged views of the upper portion of the recovery well and the jet pump injector assembly (14), respectively, of FIG. 6.
Figure 6B:
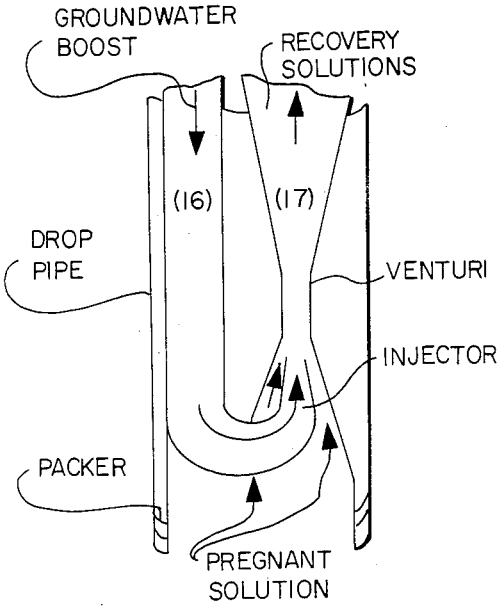
Figure 6:
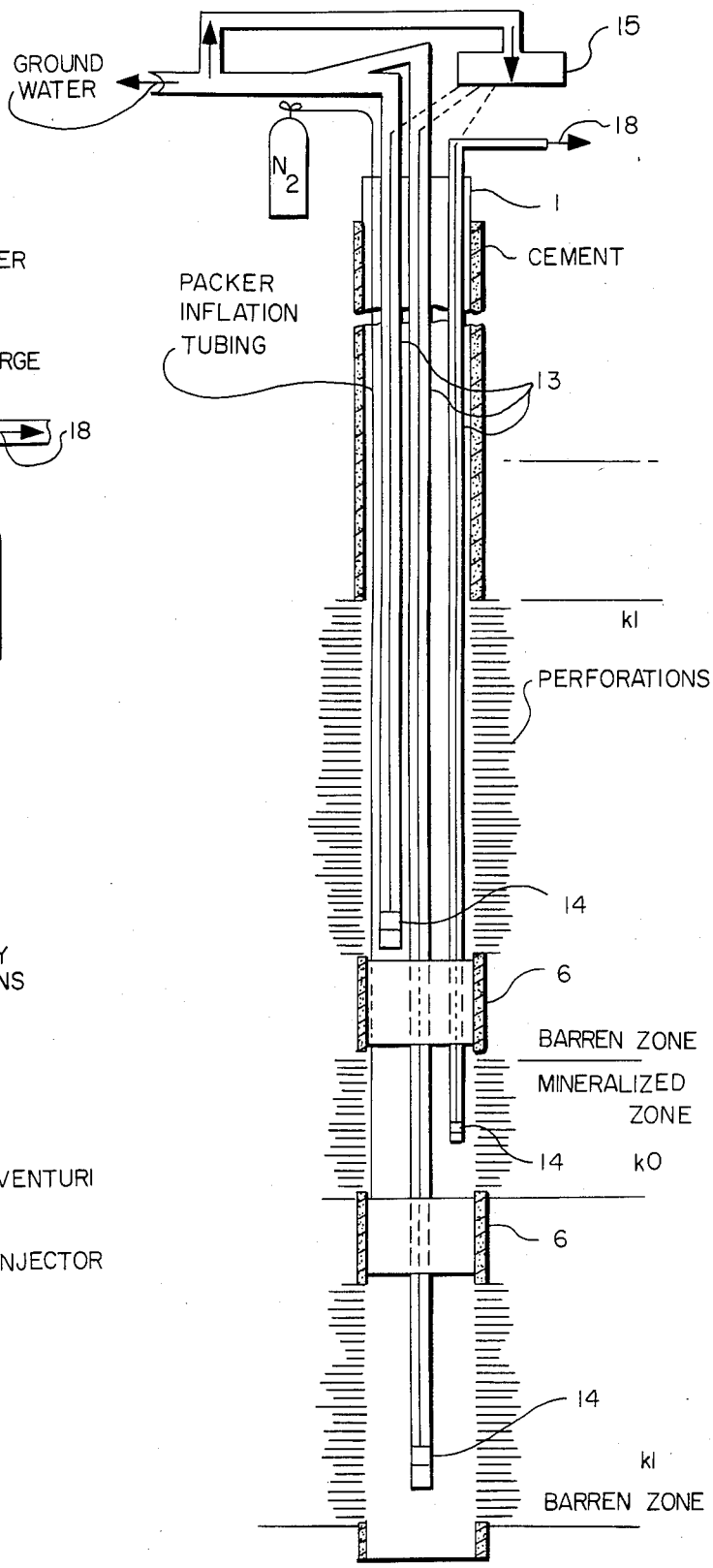
FIG. 6 is a diagram of a nested recovery well design.

In the nested recovery well illustrated in FIG. 6, the arrangement of inflatable packers (6) is similar to that of an injection well, however, a larger diameter well casing (1) is used to accomodate the drop pipes (13) for three small diameter (2 and 3 inch) deep well jet pump injector assemblies (14). One injector is set above the upper packer, one below the lower packer and a third of smaller diameter is set between the two inflatable packers. (The solution recovery rate from this zone is less owing to the lower transmissivity of the mineralized zone). A single centrifugal booster pump (15) is located on the surface. The booster pump drives all three injectors using ground water, although the recovered leach solution (between the packers) and the recovered ground water (above and below the packers) are piped and handled separately. Reverse flow injectors are used because they require less submersion depth. The inner pipe is the high pressure ground water boost (16), and the annular space is the low pressure solution recovery, (17). The recovered ground-water is recirculated to the injection wells and to the booster pump. The mineral bearing (pregnant) leach solution (18) is processed to extract the dissolved mineral values.

The leach solution is substantially or totally confined to the low permeability, mineralized zone when ground water and leachant injection (recovery) rates are proportional to barren zone and mineralized zone tramissivities. Proportionality of ground water and leachant injection (recovery) rates is achieved by maintaining equal hydrostatic pressures (fluid levels) in the three nested tubes of each injection (recovery) well.

Accordingly, it is not necessary to know in advance, the ratio of transmissivities between barren and mineralized zones in order to implement the hydraulic confinement technique of the invention. However, in any case, the corresponding ground-water and leachant inflow rates will be proportional to the transmissivities; therefore, the ratio can be back-calculated.

Figure 7:
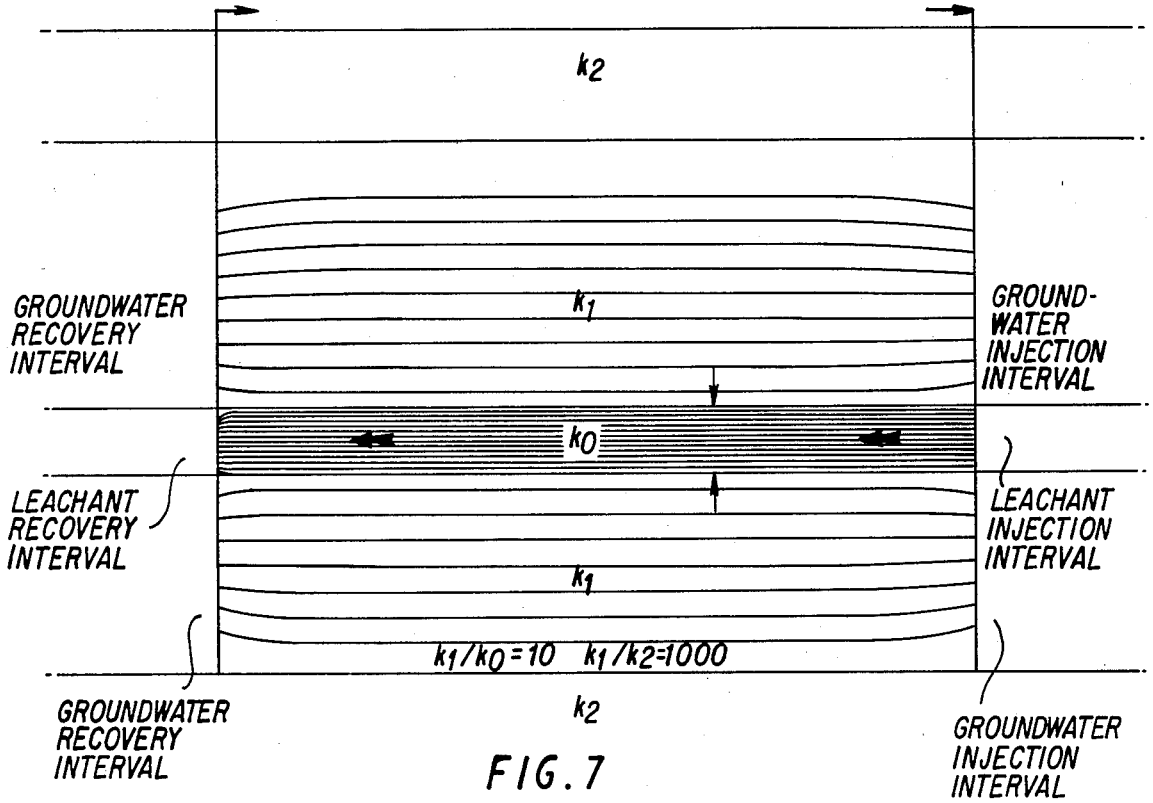
FIG. 7 is a simulated streamline pattern with nested wells and hydraulic confinement.

FIG. 7 shows the simulated streamline flow pattern that results from hydraulic confinement of leachant, using ground-water, injection and recovery from nested wells. The nested well design parameters for this simulation are summarized in Table 2. In FIG. 7, exactly as in FIG. 2, leach solution is injected and recovered from a perforated interval of casing that is the width of the mineralized zone. However in addition, ground water is injected and recovered from the overlying and underlying barren zones. Leachant and ground water flow rates are are proportional to the transmissivities of mineralized and barren layers, i.e. The fluid level is the same in all three injection tubes, and it is the same in all three recovery tubes. At every point in the flow domain the vertical components of leachant and ground-water discharge vectors cancel each other. This results in a one-dimensional leachant flow pattern in which streamline pairs (again denoted 1–7) are totally confined to the mineralized zone.

TABLE 2

Nested Injection and Recovery Well Parameters.

| Layer | Injector submersion Depth* (ft) | Total (5-well) inject/recover rate (gpm) | Jet pump diameter (in) |
|---|---|---|---|
| zone $k_2$ | — | 0 | — |
| zone $k_1$ | 47 | 68 ground water | 3 |
| zone $k_0$ | 52 | 6 leachant | 2 |
| zone $k_1$ | 63 | 62 ground water | 3 |
| zone $k_2$ | — | 0 | — |
| Booster pump discharge rate | | 340 gallons/minute | |
| Ratio of booster pump to injector discharge | | 1.5:1 | |
| Depth to water in recovery well (steady-state) | | 150 ft | |
| Depth to water in injection well (steady-state) | | 0 ft | |

Geochemical Results of Hydraulic Confinement

Figure 2:
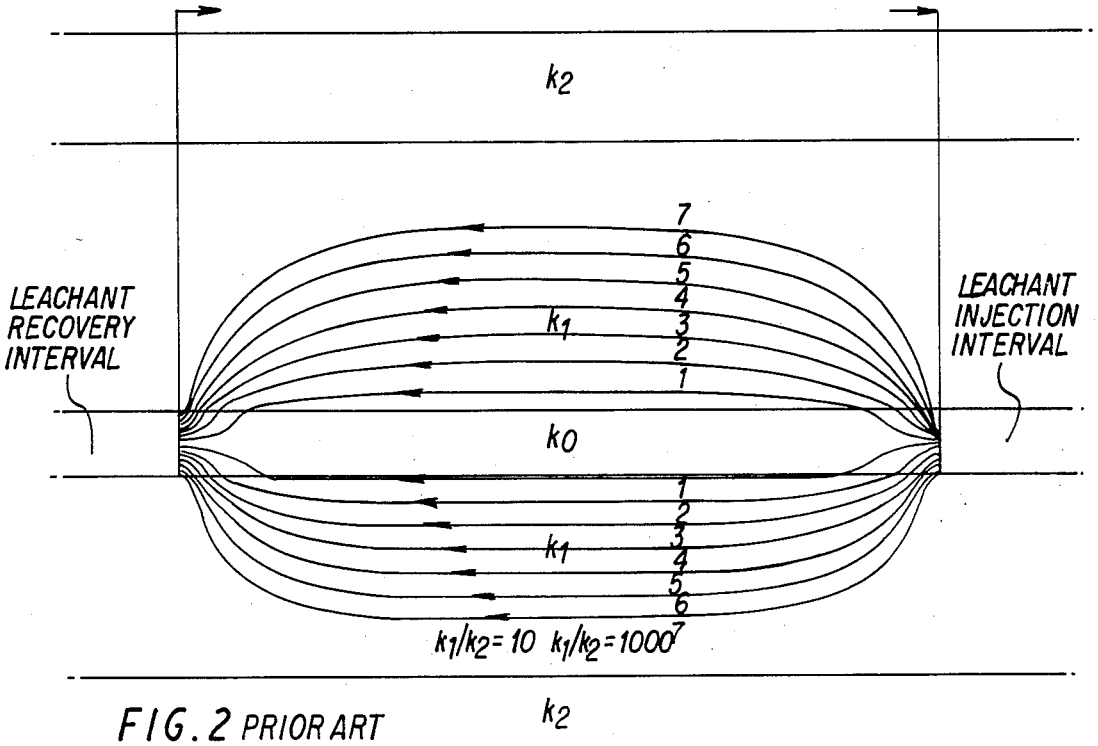
FIG. 2 PRIOR ART
FIG. 2 is a streamline plot of prior art leachant flow pattern between a single pair of injection and recovery wells, with heterogeneous permeability.
Figure 3:
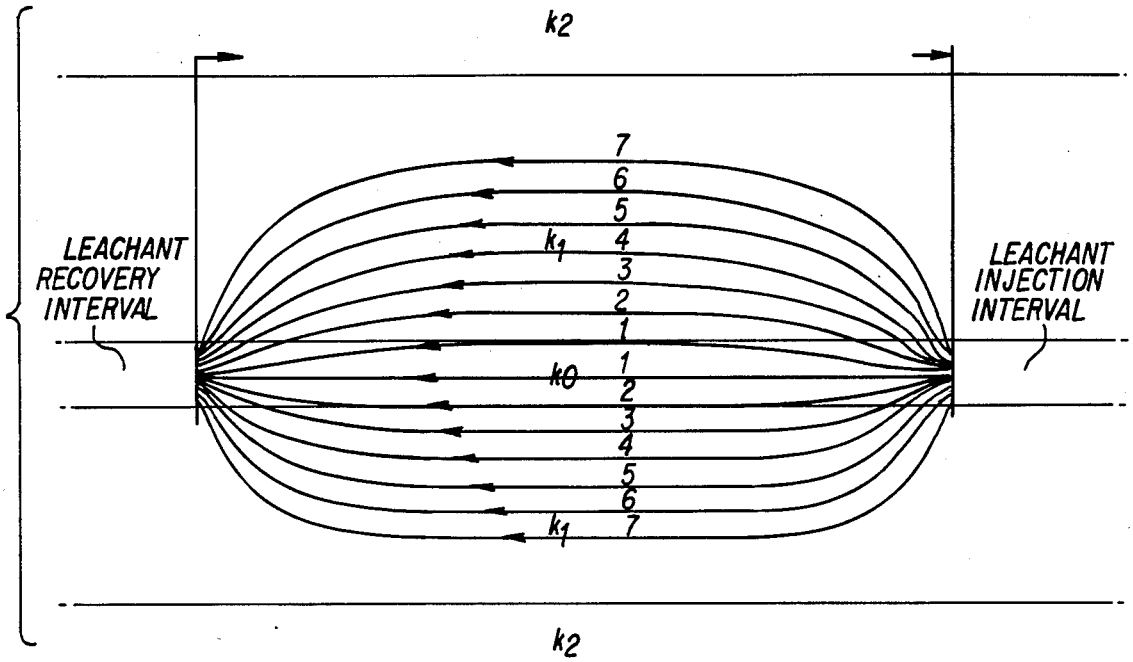
FIG. 3 PRIOR ART
FIG. 3 is a simulated streamline prior art leachant flow pattern with homogeneous permeability.

To compare the percent mineral recovery from the streamline patterns of FIGS. 2 and 7, the streamline model is coupled with a mass transport/geochemical rate model of the leaching process. The model is used for in situ leaching of uranium, to predict percent recovery as a function of pore volumes of leach solution injected. A pore volume is a volume of leach solution, normalized with respect to the porous volume of rock material that it comes in contact with. Thus, on the basis of an equivalent pore volume, it is possible to compare the results of laboratory-scale leaching experiments involving small samples of uranium ore material and small volumes of leach solution, with field-scale uranium leaching operations involving multiple wells.

Figure 8:
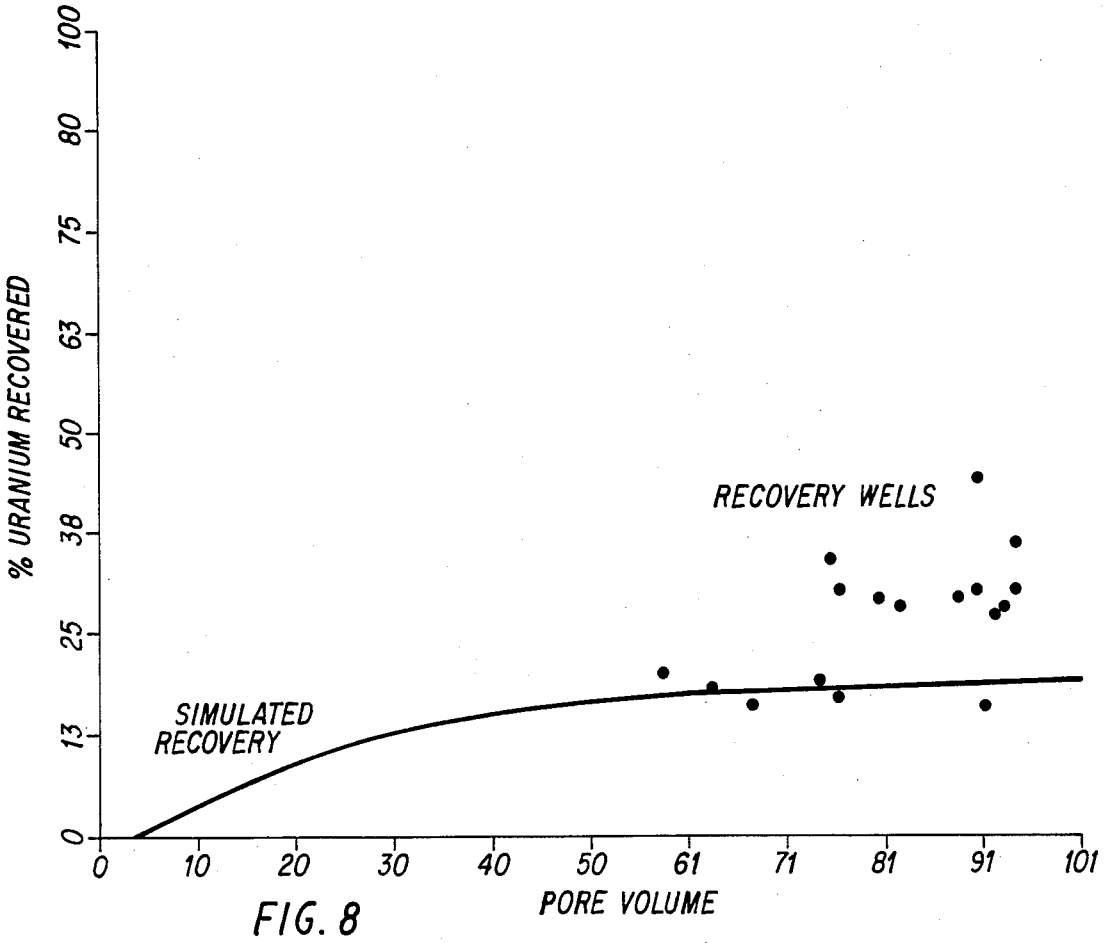
FIG. 8 is a graph of predicted and actual recovery from an in situ leaching operation.

A plot of percent uranium recovery versus pore volumes injected, is shown in FIG. 8. This figure shows actual percent mineral recovery from 17 wells at a commercial uranium leaching operation, and the predicted mineral recovery based on geochemical simulation of the leach site. The streamline pattern used in making this mineral recovery prediction is the unconfined leachant flow pattern of FIG. 2. Both actual and simulated recovery from this site are comparably low. The low recovery is due to inadequate contact between leach solution and the uranium mineralization.

Figure 9:
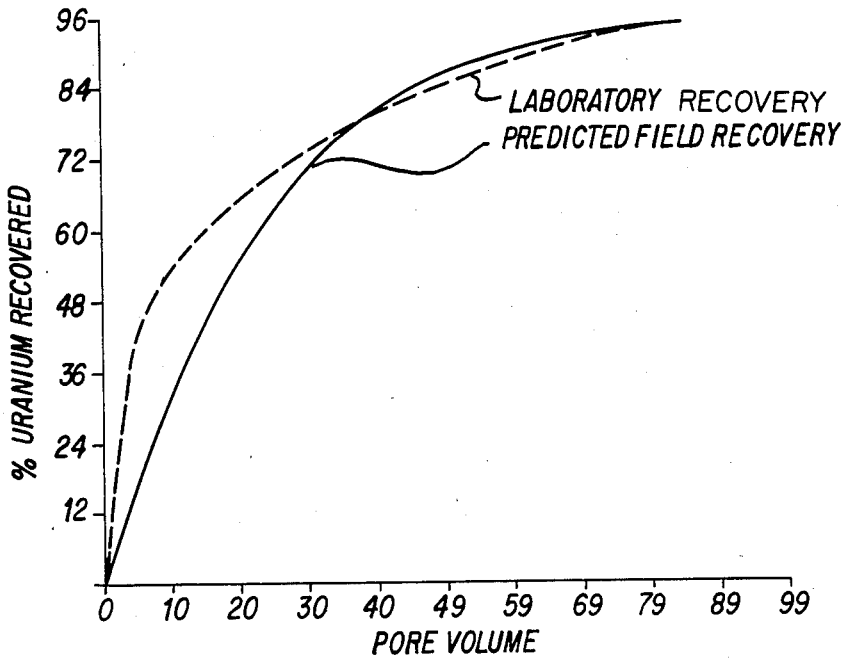
FIG. 9 is a graph of predicted and actual recovery with hydraulic confinement of leach solution.

FIG. 9 shows the impact on percent mineral recovery, of hydraulically confining leach solution to the mineralized zone at this leach site. The streamline pattern of FIG. 7 is used to make this prediction of field recovery. In FIG. 9, the prediction of field recovery, given 100% confinement of the leach solution (solid line) is validated by comparing it with the recovery from laboratory leaching experiments (dashed line) in which samples of the same uranium ore material were leached. In these laboratory experiments, the impermeable walls of the flow cell totally confined the leach solution within the ore sample.

FIGS. 8 and 9 show that, for the case of this ore deposit, total confinement of leach solution to the ore material, by using either a laboratory flow cell or the hydraulic confinement method results in almost 95% recovery of the mineral values after injecting 100 pore volumes of leachant. Without confinement the actual field recovery averaged 27% (the model predicted 21%.), after pumping 100 pore volumes of leach solution.

DESIGN AND OPERATIONAL CONSIDERATIONS

The economies that result from using ground water alone, and thereby a single booster pump to drive all three jet pump injectors in a nested recovery well are very substantial; however in the present example, the use of ground water to drive the leachant recovery jet will result in approximately a 1.5:1 dilution of the pregnant leach solution at the recovery well.

Geochemical simulations indicate that relative to the impact of an unconfined streamline pattern, where leachant is flowing primarily through barren rock, this dilution effect at the recovery well is small.

In an unconfined flow pattern, the average concentration (over time) of mineral in solution at the recovery well is highest for the interior streamlines, and lowest for the peripheral streamlines. For example, in FIG. 2, the average concentration of uranium in solution at the endpoint of streamline 1 is 237 mg/1. Streamlines 4–7 average less than 25 mg./1. at their endpoints. Over all streamlines in FIG. 2, the average mineral concentration at the recovery well is 62 mg./1.

By contrast, in the confined flow pattern of FIG. 7, the average streamline concentration at the recovery well is 364 mg/1. Dilution with ground water at the recovery well by 1.5:1 results in a solution concentration of 242 mg./1., which is almost four times the average concentration of the unconfined flow pattern. This concentration also exceeds the minimum of 50 to 100 mg./1. generally required for economical operation of a uranium site.

In commercial leaching operations, where there are several injection and recovery wells in operation, there are also other alternatives. For instance, one booster pump may be used to drive leachant recovery jets from several wells, and another may be used to drive the ground water recovery jets.

Transference of mineral values from the leach solution to the confining (ground-water) solution will occur along the boundary between mineralized and barren zones due to lateral dispersion. In order to minimize the loss of dissolved mineral values that occurs as a result of dispersion (and to meet permitting requirements for a net withdrawal of leach solution), the recovery rate of leach solution must exceed the injection rate by a small amount (10–20%). To allow this, the recovery well packers in FIG. 6 are placed further apart than those of the injection well. A small percentage of the ground water along the boundary between barren and mineralized zones (3–5%) is captured along with the injected leach solution and processed to extract dissolved mineral values.

Total confinement of leach solution is expected assuming that the transmissivity of the mineralized layers and the barren layers are individually homogeneous. However this is unlikely in an actual setting where the mineralized zone may become thicker or thinner between the injection and recovery wells or the permeability may change. Therefore, it is important to examine the flow behavior of a leach solution under conditions of partial confinement, i.e., when ground water injection is less than that which the proportionality constant ($k_1/k_0$) indicates is necessary for total confinement. This is equivalent to underestimating the average permeability of the high permeability barren layer, or overestimating the average permeability of the low permeability mineralized layer.

Three levels of partial confinement are considered, 50%, 25% and 13% of total confinement. Streamline plots showing the pattern of leachant flow for each of these cases are presented in FIGS. 10, 11, and 12 respectively. When it is recalled that leachant streamlines have equally spaced starting points on the open interval of injection wells, and that equal volumes of leach solution flow between the lines anywhere in the pattern, it is clear from these figures that the volume of leach solution which flows through the low permeability mineralized zone is proportional to the level of confinement.

Figure 10:
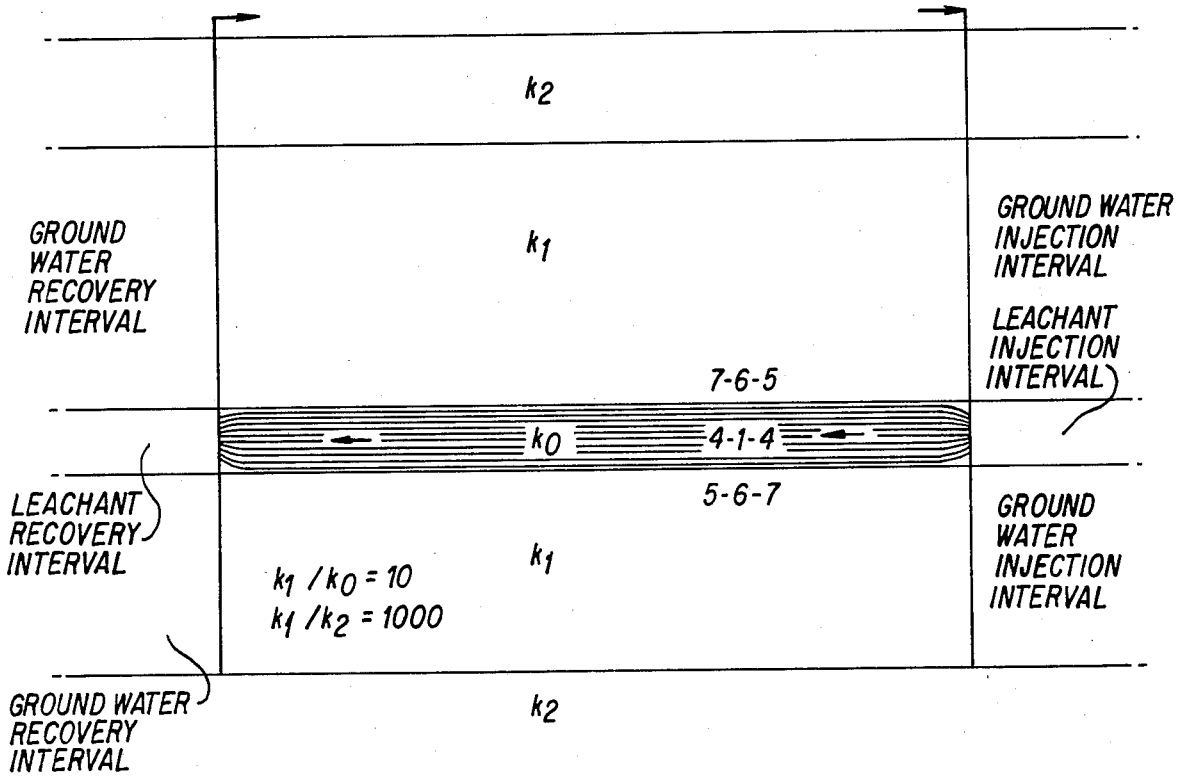
FIG. 10 is a leachant streamline pattern with 50% hydraulic confinement.
Figure 11:
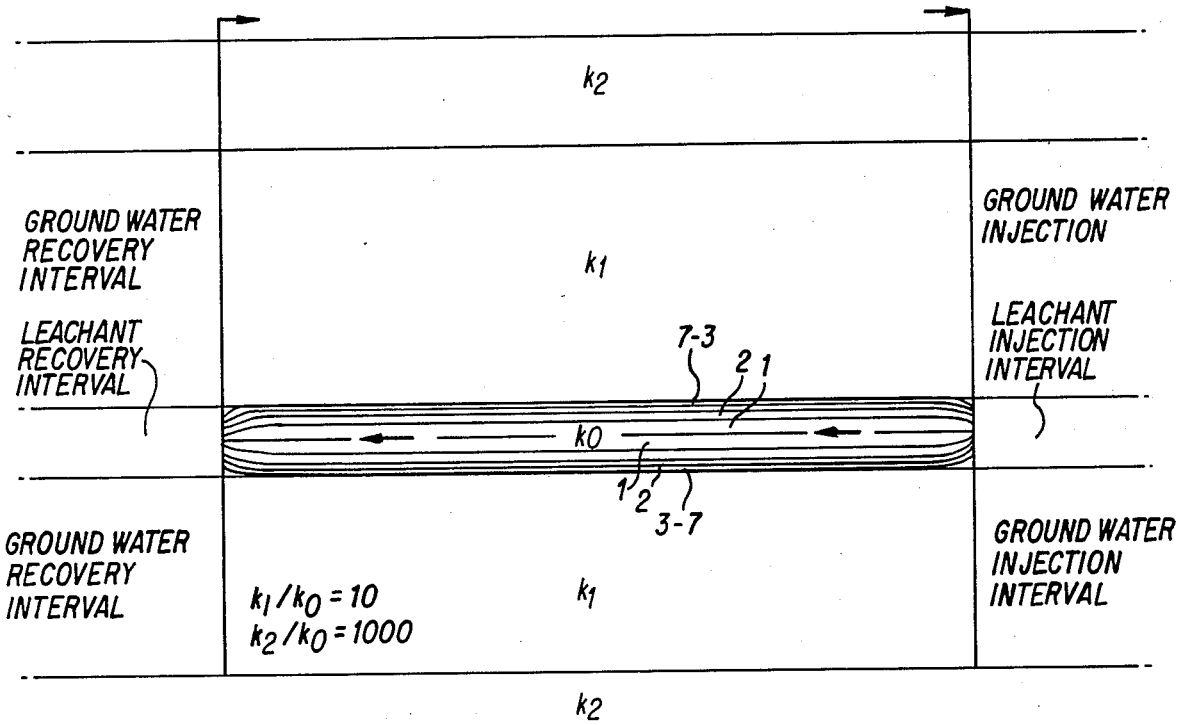
FIG. 11 is a leachant streamline pattern with 25% hydraulic confinement.
Figure 12:
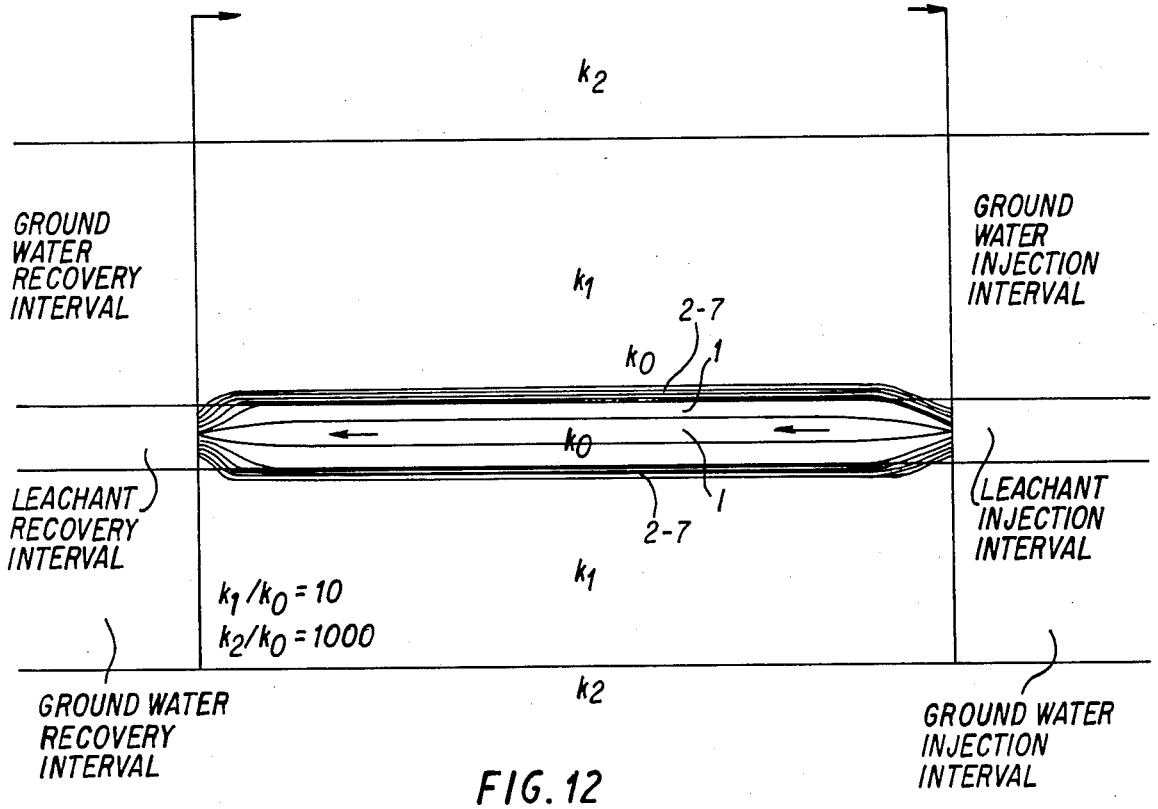
FIG. 12 is a leachant streamline pattern with 13% hydraulic confinement.

For example FIG. 10, ground-water injection is 50% of the required for total confinement, thus approximately 50% of the leach solution remains entirely inside the mineralized zone in the interval between injection and recovery wells, and approximately 50% flows through barren rock. In FIGS. 11 and 12, approximately 25% and 13% respectively of the leach solution remains inside the mineralized zone.

Figure 4:
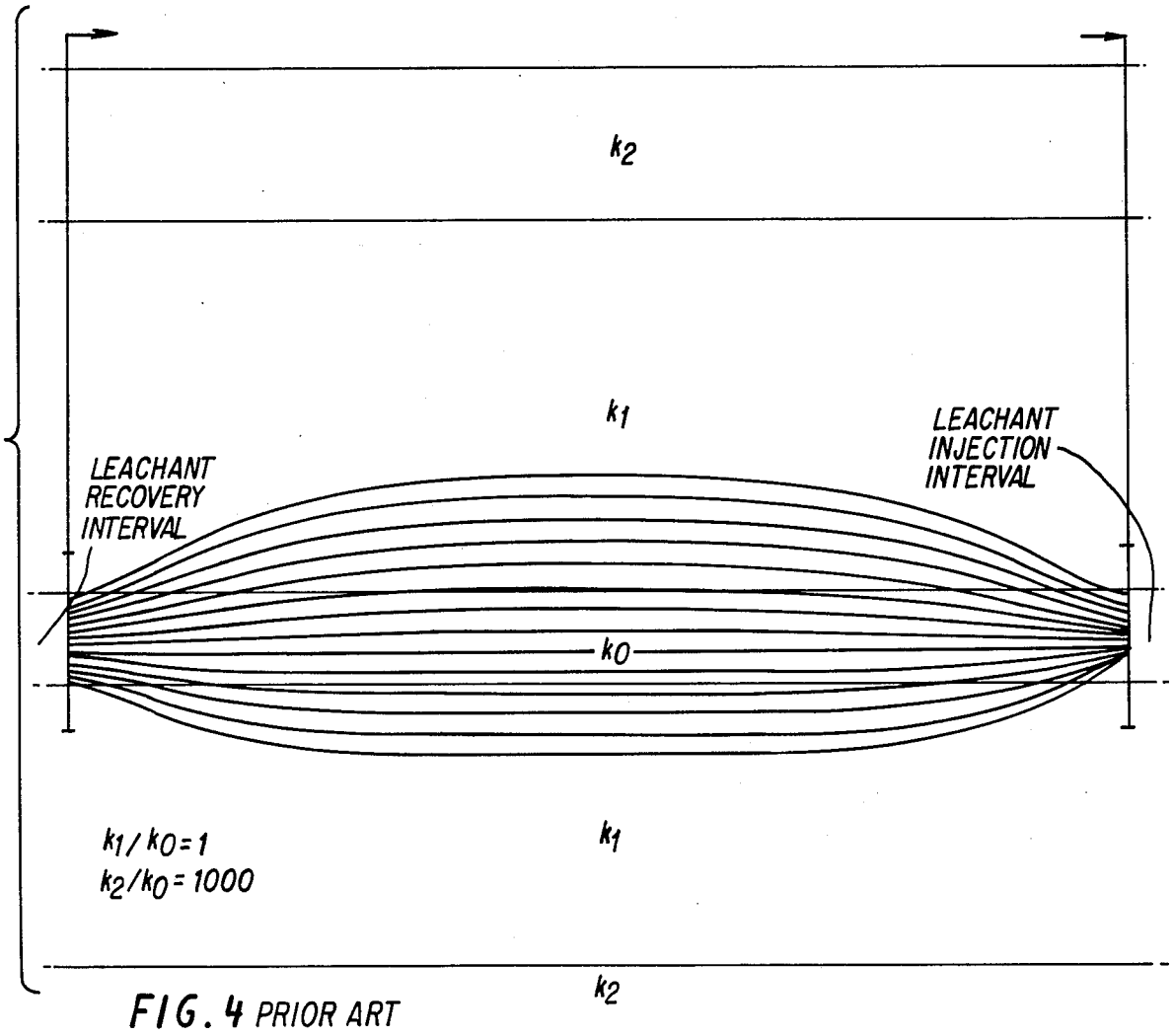
FIG. 4 PRIOR ART
FIG. 4 is a simulated streamline prior art pattern with extended injection and recovery intervals.

By comparing these figures with FIG. 2 it is clear that confinement far less than the ideal of 100% produces significant increases in solution/mineral contact. In FIG. 11 for instance, where $k_1/k_0=10$, achieving even 25% of total confinement by ground-water injection is a significant improvement, comparable to the result that is achieved in FIG. 4, by extending the perforated interval and injecting 20 times the amount of leach solution.

Alternate Embodiments of the Invention.

Imbalances in the confinement pressure above and below the mineralized zone can result from local variations in the thickness or permeability of mineralized or barren rock layers.

Figure 13:
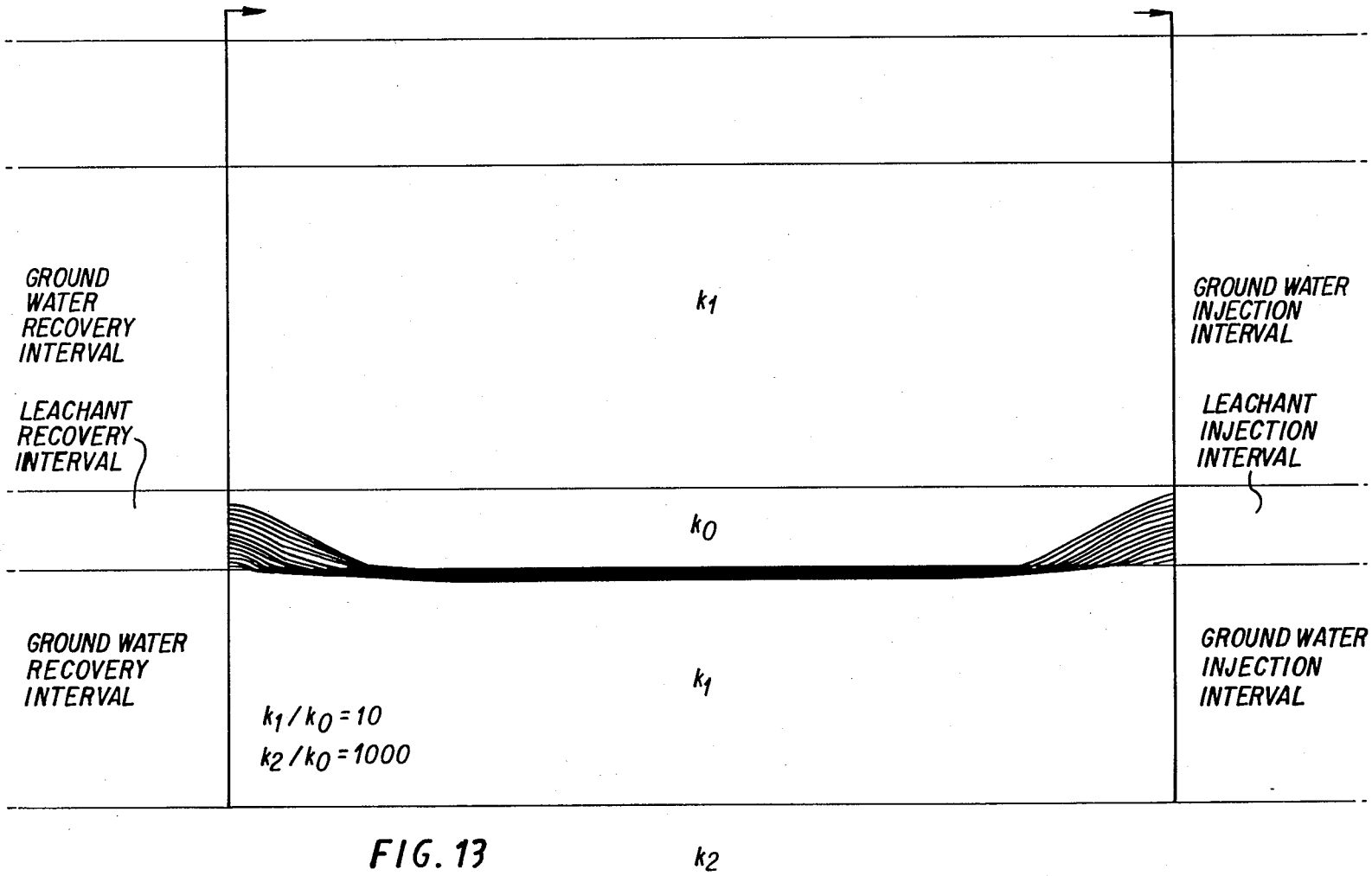
FIG. 13. is a streamline pattern resulting from confinement pressure imbalance.

Imbalances in confinement pressure can also be artificially induced by varying the fluid level (and thus the injection and recovery rates) in the two ground-water tubes within each well. For instance, FIG. 13 shows the streamline pattern that results from total confinement above the mineralized zone and 90% confinement below. It is not surprising that leachant streamlines tend toward the bottom of the mineralized zone and escape into the lower barren zone.

Time-dependent imbalances in confinement pressure can be induced by alternately varying the ground-water injection and recovery rates above and below the mineralized zone, (leachant injection and recovery remaining fixed, however). This results in total confinement conditions above the mineralized zone and partial confinement conditions below, followed by partial confinement above the mineralized zone and total confinement below and so forth. These adjustments in confinement pressure cause an oscillating, time-dependent leachant flow pattern to develop, in which leach solution moves up and down in the mineralized zone in response to a transient vertical pressure gradient, as it also moves horizontally in response to steady-state leachant injection and recovery.

This oscillating pattern of leachant flow within the mineralized zone means that travel time for leach solution between injection and recovery wells is significantly increased. The pattern is therefore well-suited to insuring maximum contact between leach solution and mineral. Extended contact time is especially important when uranium values are bound with organic matter, and as a consequence the oxidation rate is extremely slow.

Figure 14:
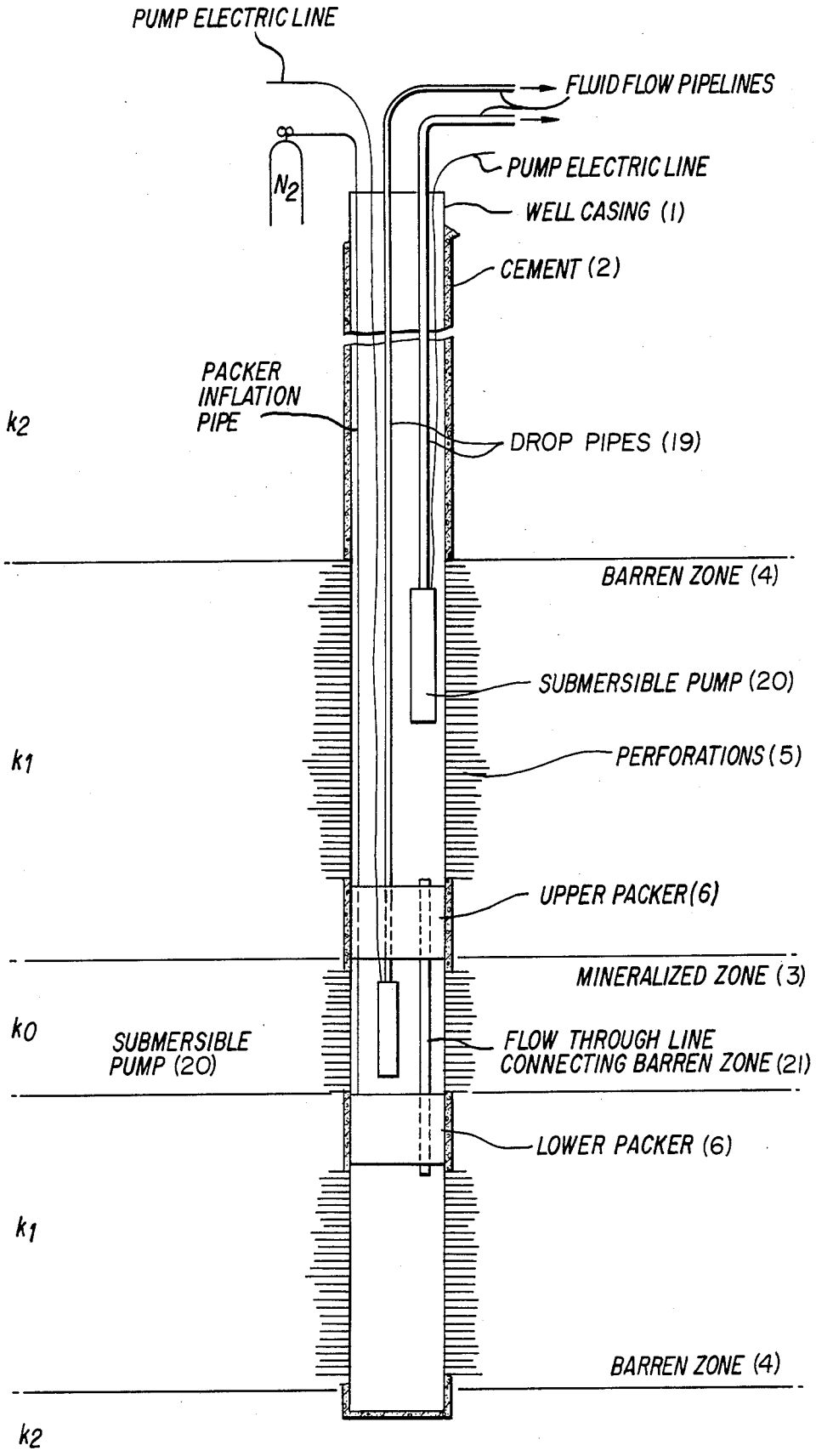
FIG. 14 is a diagram of a nested production well utilizing submersible pumps.

For recovery wells beyond a depth of 1000 feet jet pumps are no longer practical. An alternative, illustrated in FIG. 14, involves the use of two submersible pumps. As before, a well casing (1) is cemented (2) through both mineralized (3) and barren (4) zones, and then perforated (5). Two inflatable packers (6) are again used to isolate the mineralized and barren zones. Two smaller diameter drop pipes (19) with attached submersible pumps (20) are lowered in the well along with the packers. One pump is set between the two packers, the other is set above the shallow packer. A short length of pipe, (21) open above the shallow packer and below the deep packer permits communication between the upper and lower barren zones. With this design, the ground-water recovery rates above and below the mineralized zone cannot be independently controlled. Rather they will be proportional to the transmissivities of these zones.

Figure 1:
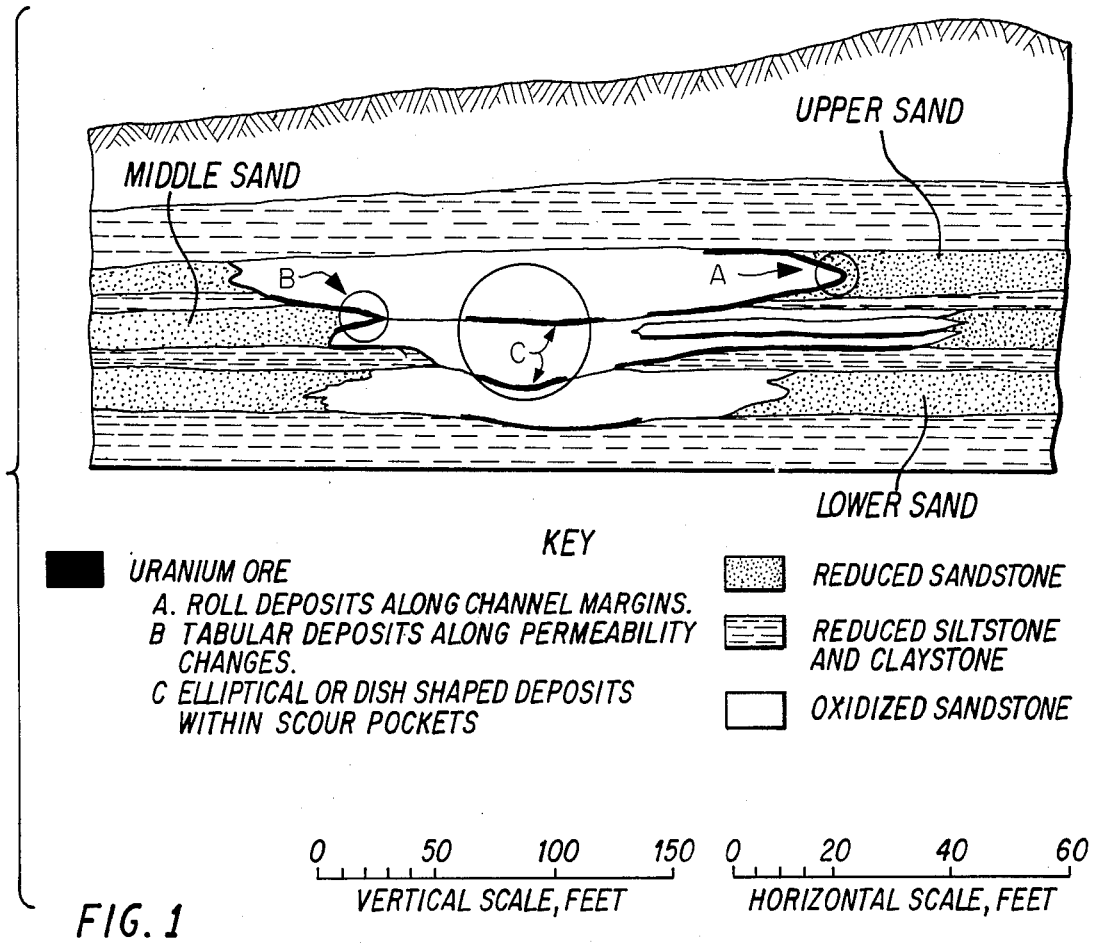
FIG. 1 is a cross-section showing various types of leachable uranium deposits.

Hydraulic confinement is also appropriate for situations where the mineralized zone is bounded by a single confining bed, either above or below the ore zone. In FIG. 1 this corresponds to a type B deposit. In this case, confinement pressure induced by ground water injection and recovery, is required on one side of the mineral deposit only.

The advantages of the invention over prior art mineral deposit extraction processes are as follows:

a. Increase in the percent of leach solution contacting ore material from less than 5% with prior practice, to near 100% with hydraulic confinement (see FIGS. 2 and 7);

b. Increase in percent mineral recovery after 100 pore volumes injected is from 27% with prior practice to 95% with hydraulic confinement (see FIGS. 8 and 9);

c. Reduction in volume of leach solution required to contact 100% of ore material is approximately 1/60 of prior practice;

d. Reduction in solution volume processed for extraction of mineral values is approximately 1/10 of prior practice, with 3–5% net withdrawal of leachant and ground water from the site, and 1.5:1 dilution using ground water to drive leachant jet pumps;

e. Hydraulic confinement of leach solution to the mineralized zone minimizes leachant contact within the aquifer and therefore the physical extent of post-leach aquifer cleanup and restoration required;

f. Hydraulic confinement provides an additional margin of safety, preventing excursions of leaching solution into the aquifers should there exist undetected fractures or other discontinuities in the natural confining beds above and below the mineralized zone; and g. Significant cost savings result from using a single booster pump to drive multiple jet pump injectors and the use of ground water to drive the leachant injector eliminates the need for special corrosion resistant materials in the booster pump.

What is claimed is:

1. A process for obtaining increased yields of minerals from bedded ore deposits in the absence of natural confining beds, by substantially confining the flow of leach solution to the mineralized zone through operation of wells comprising, the steps of:

(a) separately injecting ground water into the barren zones above and below the mineralized zone while simultaneously and separately injecting leaching solution into the mineralized zone at an injection well location, and (b) separately recovering ground water from barren zones while simutalenously and separately recovering leaching solution from the mineralized zone at a recovery well location.

2. The process of claim 1, wherein said ground water is injected into and recovered from barren zones overlying and underlying said ore mineralized zones.

3. The process of claim 1, wherein said ground water is injected into and recovered from barren zones overlying said mineralized zones.

4. The process of claim 1, wherein said ground water is injected into and recovered from barren zones underlying said mineralized zones.

5. The process of claim 1, wherein said wells are multiple injection or multiple recovery wells.

6. The process in claim 1 wherein the ratio of groundwater to leachant injection or recovery in a multiple injection or recovery well is proportional to the transmissivities of barren and mineralized zones.

7. The process of claim 2 wherein imbalances in confinement pressure are induced by varying rates of ground water injection and recovery in said overlying and underlying barren zones.

8. A nested injection well construction, for extracting increased yields of minerals from bedded ore deposits bounded by barren confining zones comprising, a well casing placed in an open hole and cemented from the surface completely through mineralized zones and barren zones, said casing and said cemented areas being perforated throughout the mineralized and barren zones except for short unperforated intervals at the top and bottom of said mineralized zone, said casing having therein an assembly consisting of an inflatable upper and lower packer and two small diameter solution-injection access pipes of different lengths, to provide fluid flow thru said packers, one of said access pipes is open to the well in an interval of length between the two packers in the mineralized zone and the other of said pipes extends through both packers so as to allow said packers to set at levels of unperforated casing, and is open to the well below the lower packer.

9. A nested recovery well construction for deposits bounded by barren confining zones comprising, a well casing placed in an open hold and cemented from the surface completely through mineralized and barren zones, said casing and said cemented areas being perforated throughout the mineralized and barren zones, said casing having therein an assembly consisting of an inflatable upper and lower packer, and three small diameter solution-injection access pipes of different lengths with jet-pump injector assemblies attached at the end;

one length of pipe is set above the upper packer, another length of pipe is set between the two packers in the mineralized zone, and a third length of pipe extends through both packers so as to allow said packers to set at levels of unperforated casing, and is open to the well below the lower packer, and wherein all of said pipes extend from the earth's surface and is open to the well.

* * * * *